US007691007B2

(12) United States Patent
Ban et al.

(10) Patent No.: US 7,691,007 B2
(45) **Date of Patent: *Apr. 6, 2010**

(54) GOLF CLUB HEAD

(75) Inventors: Wataru Ban, Chichibu (JP); Vinh-Duy Thai Nguyen, Lake Forest, CA (US)

(73) Assignee: Bridgestone Sports Co., Ltd., Tokyo (JP)

( * ) Notice: Subject to any disclaimer, the term of this patent is extended or adjusted under 35 U.S.C. 154(b) by 172 days.

This patent is subject to a terminal disclaimer.

(21) Appl. No.: 11/619,632

(22) Filed: Jan. 4, 2007

(65) Prior Publication Data

US 2008/0167138 A1 Jul. 10, 2008

(51) Int. Cl.
*A63B 53/04* (2006.01)

(52) U.S. Cl. ..... 473/330; 473/331

(58) Field of Classification Search ..... 473/324–350, 473/287–291

See application file for complete search history.

(56) References Cited

U.S. PATENT DOCUMENTS

| | | | | |
|---|---|---|---|---|
| 1,289,553 | A | 12/1918 | Sanders | |
| 1,337,958 | A | 4/1920 | Reach | |
| 1,965,954 | A | 7/1934 | Davis | |
| 2,005,401 | A | 6/1935 | Storz et al. | |
| D190,035 | S | 4/1961 | Hansen, Jr. | |
| 3,693,978 | A | 9/1972 | East | |
| 4,067,572 | A | 1/1978 | Coleman | |
| 4,413,825 | A | 11/1983 | Sasse | |
| 4,753,440 | A | 6/1988 | Chorne | |
| 4,858,929 | A | 8/1989 | Long | |
| 4,957,294 | A | 9/1990 | Long | |
| 5,029,864 | A | 7/1991 | Keener | |
| 5,100,144 | A * | 3/1992 | Okumoto et al. | 473/331 |
| 5,437,088 | A | 8/1995 | Igarashi | |
| 5,591,092 | A | 1/1997 | Gilbert | |
| 5,637,044 | A | 6/1997 | Swash | |
| 5,688,186 | A * | 11/1997 | Michaels et al. | 473/290 |
| 5,709,616 | A | 1/1998 | Rife | |
| 5,744,780 | A | 4/1998 | Chang et al. | |
| 5,766,087 | A | 6/1998 | Kawamatsu | |
| 5,766,097 | A | 6/1998 | Horiuchi et al. | |

(Continued)

FOREIGN PATENT DOCUMENTS

| | | | |
|---|---|---|---|
| JP | 02-026574 | A | 1/1990 |

(Continued)

*Primary Examiner*—Sebastiano Passaniti
(74) *Attorney, Agent, or Firm*—Paul, Hastings, Janofsky & Walker LLP

(57) ABSTRACT

This invention provides a plurality of grooves formed on a face of the golf club head. Each of a pair of side surfaces of each of the grooves has a first surface leading to the face and a second surface leading to the first surface in the depth direction of the groove. A first angle between the first surfaces of each of said pair of the side surfaces is larger than a second angle between the second surfaces of each of the said pair of the side surfaces. Edges of the groove are rounded. A width W (mm) of the groove measured including the rounded edges, a width Ws (mm) between the grooves adjacent one another, a width Wr (mm) of the groove measured based on the 30 degrees measurement rule and a cross section area S ($mm^2$) of the groove satisfy the following expressions; $W/Ws \times 100 \geqq 40$ (%), $S/(Ws \times 0.5) \times 100 \geqq 70$(%).

6 Claims, 7 Drawing Sheets

U.S. PATENT DOCUMENTS

| | | | | |
|---|---|---|---|---|
| 5,785,610 | A | 7/1998 | Birmingham | |
| 5,788,584 | A | 8/1998 | Parente et al. | |
| 6,733,400 | B2 | 5/2004 | Sherwood | |
| 6,814,673 | B2 * | 11/2004 | Wahl et al. | 473/331 |
| 6,849,004 | B2 | 2/2005 | Lindsay | |
| 6,981,923 | B2 | 1/2006 | Chappell | |
| 7,014,568 | B2 * | 3/2006 | Pelz | 473/287 |
| 7,056,226 | B2 | 6/2006 | Kennedy | |
| 7,066,833 | B2 | 6/2006 | Yamamoto | |
| 7,156,751 | B2 | 1/2007 | Wahl et al. | |
| 7,159,292 | B2 | 1/2007 | Suzuki et al. | |
| 7,166,039 | B2 | 1/2007 | Hettinger et al. | |
| 7,179,175 | B2 * | 2/2007 | Kennedy, III | 473/330 |
| 7,192,361 | B2 | 3/2007 | Gilbert et al. | |
| 7,258,627 | B2 * | 8/2007 | Chappell | 473/331 |
| 7,275,999 | B2 * | 10/2007 | Sherwood | 473/290 |
| 7,285,057 | B2 | 10/2007 | Mann et al. | |
| 7,327,017 | B2 | 2/2008 | Sirinorakul et al. | |
| 2002/0016218 | A1 | 2/2002 | Takeda | |
| 2002/0042306 | A1 | 4/2002 | Chappell et al. | |
| 2002/0132683 | A1 | 9/2002 | Buchanan | |
| 2003/0008724 | A1 | 1/2003 | Griffin | |
| 2004/0087387 | A1 | 5/2004 | Wahl et al. | |
| 2005/0037859 | A1 | 2/2005 | Gilbert et al. | |
| 2005/0075191 | A1 | 4/2005 | Bennett | |
| 2005/0130761 | A1 | 6/2005 | Vokey et al. | |
| 2005/0143187 | A1 | 6/2005 | Kennedy | |
| 2005/0413187 | | 6/2005 | Kennedy | |
| 2006/0003851 | A1 | 1/2006 | Chappell et al. | |
| 2006/0154739 | A1 | 7/2006 | Mann, Jr. et al. | |
| 2006/0223648 | A1 | 10/2006 | Kennedy | |
| 2007/0010346 | A1 | 1/2007 | Gilbert et al. | |
| 2007/0149312 | A1 | 6/2007 | Gilbert | |
| 2008/0020859 | A1 | 1/2008 | Yamagishi et al. | |
| 2008/0032814 | A1 | 2/2008 | Ban | |
| 2008/0051212 | A1 | 2/2008 | Voges | |
| 2008/0102981 | A1 | 5/2008 | Nguyen et al. | |
| 2008/0108453 | A1 | 5/2008 | Park et al. | |
| 2008/0125242 | A1 | 5/2008 | Ban et al. | |
| 2008/0125243 | A1 | 5/2008 | Ban | |
| 2008/0132351 | A1 | 6/2008 | Ban et al. | |
| 2008/0132352 | A1 | 6/2008 | Ban | |
| 2008/0242442 | A1 | 10/2008 | Gilbert et al. | |
| 2009/0011852 | A1 | 1/2009 | Solheim et al. | |
| 2009/0029797 | A1 | 1/2009 | Ban et al. | |
| 2009/0036228 | A1 | 2/2009 | Ban et al. | |
| 2009/0082129 | A1 | 3/2009 | Ban et al. | |

FOREIGN PATENT DOCUMENTS

| | | | |
|---|---|---|---|
| JP | 08-000777 | A | 1/1996 |
| JP | 08-229169 | A | 9/1996 |
| JP | 09-308715 | A | 2/1997 |
| JP | 09-070457 | A | 3/1997 |
| JP | 09-192274 | A | 7/1997 |
| JP | 09253250 | A | 9/1997 |
| JP | 09-308714 | A | 12/1997 |
| JP | 10-015116 | A | 1/1998 |
| JP | 10-179824 | A | 7/1998 |
| JP | 10-248974 | A1 | 9/1998 |
| JP | 2001178856 | A | 7/2001 |
| JP | 2002126135 | A | 5/2002 |
| JP | 2002-224250 | A | 8/2002 |
| JP | 2002-291949 | A | 10/2002 |
| JP | 2003-093560 | A | 4/2003 |
| JP | 2005-169129 | A | 6/2005 |
| JP | 2005-287534 | A | 10/2005 |
| JP | 2007-202633 | A | 8/2007 |
| JP | 2008005994 | A | 1/2008 |
| JP | 2008079969 | A | 4/2008 |
| JP | 2001-170227 | A | 8/2009 |
| WO | 00/02627 | A1 | 1/2000 |
| WO | 00/74799 | A1 | 12/2000 |
| WO | 01/97924 | A1 | 12/2001 |
| WO | 03045507 | A1 | 6/2003 |

* cited by examiner

FIG. 5

| | GROOVE SPECIFICATIONS | | | | | | | | | | | | | |
|---|---|---|---|---|---|---|---|---|---|---|---|---|---|---|
| | CROSS SECTION SHAPE | ANGLE θ1 (°) | ANGLE θ2 (°) | ROUNDING RADIUS (mm) | GROOVE WIDTH W (mm) | RULE-BASED WIDTH Wr (mm) | WIDTH Ws BETWEEN GROOVES (mm) | PITCH (mm) | GROOVED AREA RATIO (%) | GROOVE DEPTH D (mm) | CROSS SECTION AREA S (mm²) | CROSS SECTION AREA RATIO (%) | RULE CONFORMITY |
| COMPARATIVE EXAMPLE 1 | SINGLE SIDE SURFACE (TRAPEZOIDAL) | 30 | – | 0 | 0.90 | 0.9 | 2.70 | 3.60 | 33 | 0.50 | 0.383 | 85 | ○ |
| COMPARATIVE EXAMPLE 2 | | 60 | | | | | | | | | 0.306 | 68 | |
| COMPARATIVE EXAMPLE 3 | SINGLE SIDE SURFACE (V-SHAPED) | 90 | | | | | | | | 0.45 | 0.203 | 45 | |
| COMPARATIVE EXAMPLE 4 | | 120 | | | | | | | | 0.26 | 0.117 | 26 | |
| COMPARATIVE EXAMPLE 5 | SINGLE SIDE SURFACE (TRAPEZOIDAL) | 15 | | | | | 8.60 | 9.50 | 10 | 0.50 | 0.417 | 93 | |
| COMPARATIVE EXAMPLE 6 | | | | | | | 2.70 | 3.60 | 33 | | | | |
| COMPARATIVE EXAMPLE 7 | | | | | | | 1.35 | 2.25 | 67 | | | | × |
| COMPARATIVE EXAMPLE 8 | | 75 | | 0.2 | 1.10 | | 2.50 | 3.60 | 44 | | 0.262 | 58 | ○ |
| EXAMPLE 1 | SIDE SURFACE SEGMENTED INTO TWO SURFACES | 66 | 26 | 0.2 | 1.07 | 0.9 | 2.53 | 3.60 | 42 | 0.45 | 0.341 | 80 | ○ |
| EXAMPLE 2 | | 30 | 15 | | 0.90 | 0.7 | 1.93 | 2.83 | 47 | | 0.284 | 80 | |

FIG. 6

| | EXPERIMENTAL RESULT | | |
|---|---|---|---|
| | DEGREE OF SCRATCHES | AMOUNT OF SPIN (rpm) | |
| | | DRY | WET |
| COMPARATIVE EXAMPLE 1 | 8 | 9830 | 4500 |
| COMPARATIVE EXAMPLE 2 | 6 | 9960 | 2800 |
| COMPARATIVE EXAMPLE 3 | 4 | 10050 | 1580 |
| COMPARATIVE EXAMPLE 4 | 1 | 9950 | 1170 |
| COMPARATIVE EXAMPLE 5 | 7 | 10532 | 3266 |
| COMPARATIVE EXAMPLE 6 | 9 | 9610 | 7130 |
| COMPARATIVE EXAMPLE 7 | 10 | 8760 | 9841 |
| COMPARATIVE EXAMPLE 8 | 1 | 9650 | 3000 |
| EXAMPLE 1 | 4 | 9908 | 4000 |
| EXAMPLE 2 | 6 | 9600 | 7000 |

GOLF CLUB HEAD

BACKGROUND OF THE INVENTION

1. Field of the Invention

The present invention relates to a golf club head, and particular to a groove formed on the face thereof.

2. Description of the Related Art

It is provided on a face of a golf club head plurality of grooves, called marking line, score line or face line grooves. These grooves affect an amount of spin of a ball. In the case of the golf club head of an iron club, especially the wedge, it is desirable to form the grooves in order to increase the amount of spin of a ball.

Japanese Patent Application Laid-Open No. 9-192274 discloses a golf club having grooves of V-shaped or trapezoidal cross section. Japanese Patent Application Laid-Open No. 9-70457 and No. 10-179824 disclose a golf club head having grooves edges (boundary portions between side surfaces of the grooves and a face)of which are rounded. This rounding has an effect of preventing a golf ball from getting damaged (for example, scratches and the like). Japanese Patent Application Laid-Open No. 2003-93560 and No. 2005-287534 disclose a golf club head having grooves each of which has a side surface formed not by a single surface, but by two differently angled surfaces. Incidentally, a golf club head used in official games is subject to constraints on the width and depth of a groove specified by the rules. Therefore, in consideration of applications in official games, it is required to design a golf club head in a range to meet the rules.

Now, an amount of spin of a golf ball in the rain or hitting a shot in the rough tends to be smaller than without the rain or hitting on the fairway. For preventing the amount of spin of a ball in the rain or a shot in the rough from decreasing, it is effective to enlarge a volume of a groove on the face. The enlargement of the volume of the groove allows grass and dust sandwiched between the face and a ball to easily get away into the groove and improves drainage performance of water existing on the face.

A groove having a rectangular cross section can have the largest volume of the groove compared to a groove having the same width and a differently shaped cross section. However, a ball is easily damaged because of an increase in sharpness of the edge of the groove.

On the contrary, a V-shaped or trapezoidal cross section of the groove allows a ball to be less damaged compared to the rectangular cross section. However, the volume of the groove is liable to be small. Therefore, when hitting a shot in the rain or in the rough, the amount of spin of a ball tends to be largely reduced.

In the golf club head disclosed in Japanese Patent Application Laid-Open No. 2003-93560, an enlargement of a volume of groove may increase sharpness of the groove edges, and therefore, a ball may be susceptible to damage. The golf club head disclosed in Japanese Patent Application Laid-Open No. 2005-287534 may be unworkable, because a groove width on the face is narrower than that within the groove. Further, increasing sharpness of the groove edges makes a ball more susceptible to damage. Japanese Patent Application Laid-Open No. 2005-287534 also discloses rounding of the groove edges, however, when the groove edges take an angle as sharp as the grooves of Patent Application Laid-Open No. 2005-287534, a ball may be also likely to suffer damage even if the edges are rounded.

SUMMARY OF THE INVENTION

The present invention has been made in order to overcome the deficits of prior art.

According to the aspects of the present invention, it is provided a golf club head comprising:

plurality of grooves formed on a face of the golf club head; and each of a pair of side surfaces of each of the grooves having a first surface leading to the face and a second surface leading to the first surface in the depth direction of the groove, wherein a first angle between the first surfaces of each of the pair of the side surfaces is larger than a second angle between the second surfaces of each of the pair of the side surfaces, edges of the groove are rounded, and a width W (mm) of the groove measured including the rounded edges, a width Ws (mm) between the grooves adjacent one another, a width Wr (mm) of the groove measured based on the 30 degrees measurement rule and a cross section area S ($mm^2$) of the groove satisfy the following expressions; $W/Ws\times100\geqq40(\%)$, $S/(Ws\times0.5)\times100\geqq70(\%)$.

In this golf club head, the first angle between the first surfaces of each of the pair of the side surfaces is larger than the second angle between the second surfaces of each of the pair of the side surfaces. The first surface can contribute to preventing a ball from getting damaged and the second surface can contribute to securing the volume of the groove.

Further, rounding of the groove edge prevents a ball from getting damaged. While, setting of "$W/Ws\times100$" given above which is representative of an area ratio of a grooved area in the face and "$S/(Wr\times0.5)\times100$" given above which is representative of an amplitude of the volume of the groove to the values above described, along with balancing between the area ratio of the grooved area and the amplitude of the volume, allows a large decrease in the amount of spin of a ball to be avoided in the rain or a shot in the rough.

Therefore, the prevent invention can prevent the amount of spin of a ball in the rain or a shot in the rough from decreasing largely, while preventing the ball from getting damaged.

Further features of the present invention will become apparent from the following description of exemplary embodiments (with reference to the attached drawings).

BRIEF DESCRIPTION OF THE DRAWINGS

FIG. 5 shows the experimental conditions (specifications of the groove) of examples of the present invention and comparative examples;

FIG. 6 shows the experimental result of the examples of the present invention and the comparative examples.

DESCRIPTION OF THE EMBODIMENTS

Preferred embodiments of the present invention will now be described in detail in accordance with the accompanying drawings.

Figure 1:
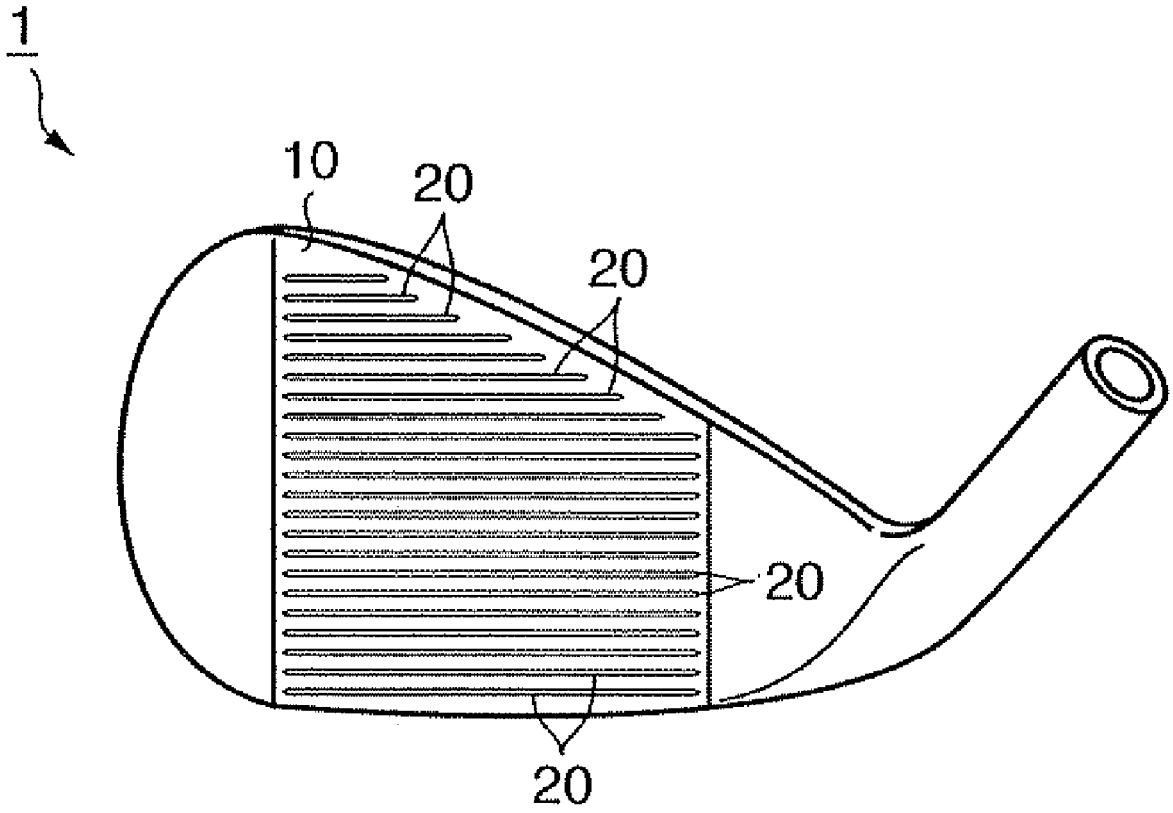
FIG. 1 is a general view of a golf club head 1 according to one embodiment of the present invention.

FIG. 1 is a general view of a golf club head 1 according to one embodiment of the present invention. In FIG. 1, an example is shown when the present invention is applied to an iron type golf club head. The present invention is suitable for golf club heads especially for wedges such as a sand wedge, a pitching wedge or an approach wedge for which a large amount of spin is required. However, the present invention is also applicable to a golf club head for a utility golf club or a wood golf club.

Figure 2A:
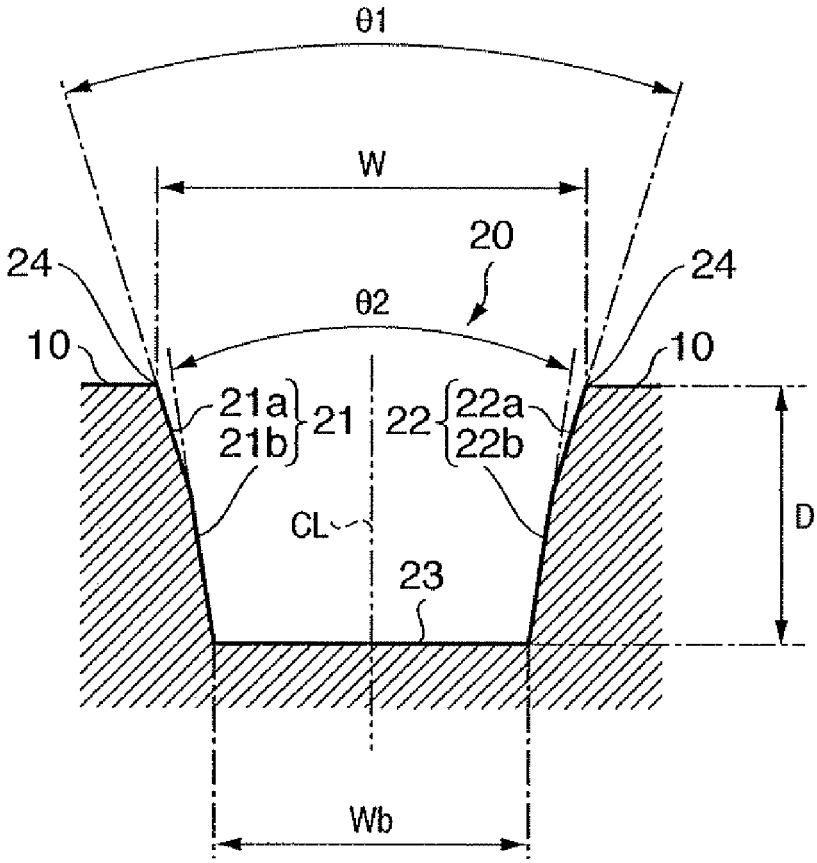
FIGS. 2A and 2B are cross sectional views of a groove 20.

The golf club head 1 has a plurality of grooves 20 formed on a face 10 thereof. In this embodiment, each of the grooves 20 is a straight groove extending in toe-to-heel direction and each pitch between the grooves 20 adjacent to one another is arranged to be equal (each pitch has the same length). FIG. 2A is a cross sectional view taken in the direction perpendicular to the longitudinal direction (toe-to-heel direction) of any one of the grooves 20. In this embodiment, the groove 20 has the same cross section shape in the longitudinal direction except for both distal ends thereof. Further, each of the plurality of grooves 20 has the same cross section shape.

The groove 20 has a pair of side surfaces 21 and 22, and a bottom surface 23. In this embodiment, the cross section shape of the groove 20 is symmetric about the center line CL thereof. Each of the pair of the side surfaces 21, 22 of the groove 20 comprises a first surface 21*a*, 22*a* leading to the face 10, and a second surface 21*b*, 22*b* leading to the first surface 21*a*, 22*a* in the depth direction of the groove 20. The bottom surface 23 is parallel to the face 10 and leads to the second surfaces 21*b* and 22*b*.

Edges 24 of the groove 20 are rounded. A radius for rounding the edge 24 is preferably equal to or more than 0.05 (mm) and not more than 0.2 (mm). This rounding provides an effect to prevent a ball from getting damaged (scratches and the like).

Figure 2B:
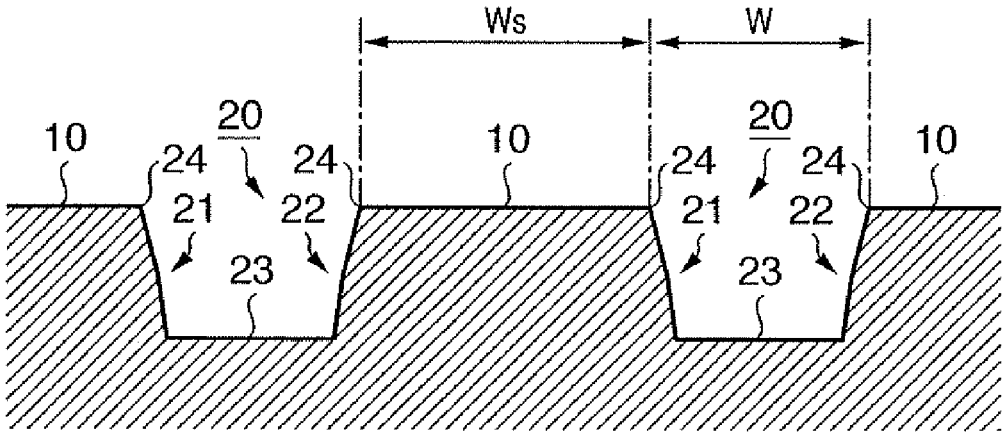
Figure 3A:
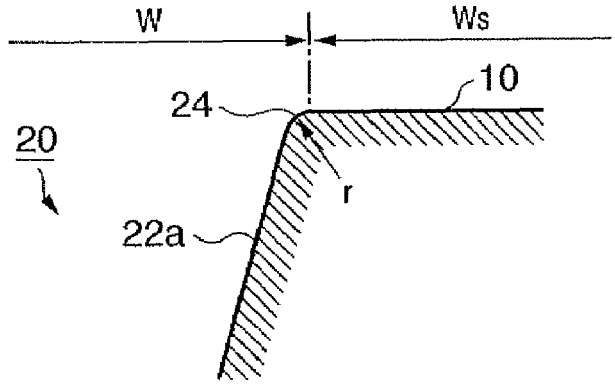
FIG. 3A is a schematic diagram illustrative of widths W and Ws.

The groove 20 has a bottom width Wb, a depth D and a width W. Further, as shown in FIG. 2B, a width Ws is defined between the grooves 20 adjacent to one another. The bottom width Wb indicates a distance between both ends of the bottom surface 23. The depth D indicates a distance from the face 10 to the bottom surface 23. The width W is a width of the groove 20 in the direction perpendicular to the longitudinal direction thereof. The width W, as shown in FIG. 3A, means a width which is measured with the roundness (a radius r) of the edges 24 of the groove 20 being included and which is to be measured from the starting point to get rounded (the position shown by a broken line in FIG. 3A). Further, the width Ws indicates a distance between the starting points to get rounded (the position shown by a broken line in FIG. 3A) of the two grooves 20 adjacent to one another.

Figure 3B:
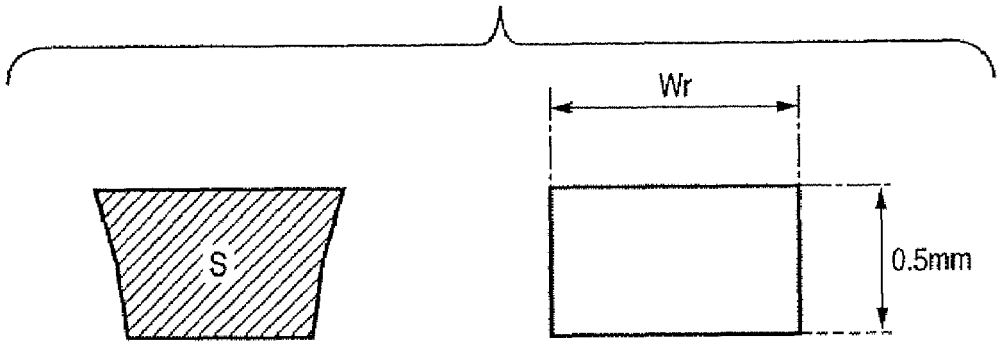
FIG. 3B is a schematic diagram illustrative of a cross section area ratio.
Figure 3C:
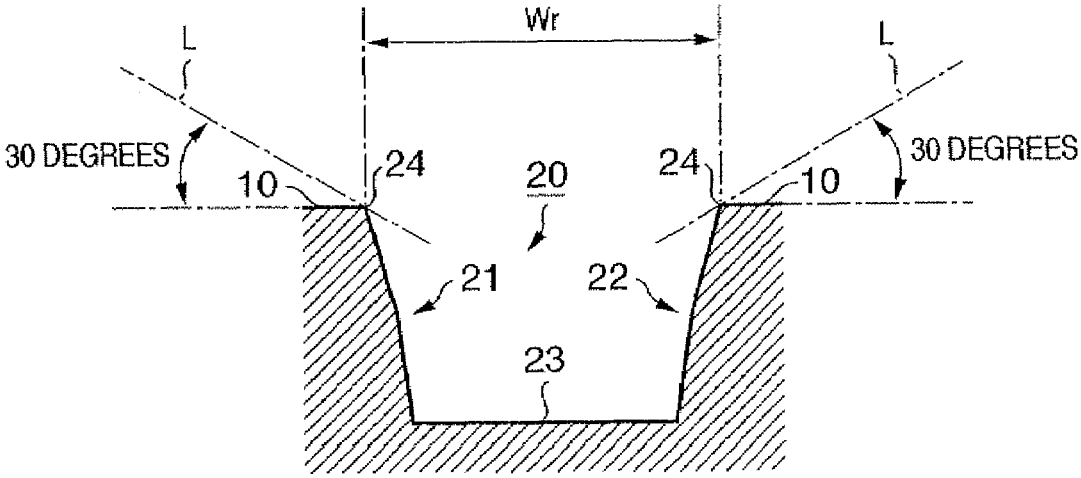
FIG. 3C is a schematic diagram illustrative of the 30 degrees measurement rule.

The term "groove width measured with the roundness being included" used herein means the width W measured by the method above described, and the width W is distinguished from a width measured based on so-called the 30 degrees measurement rule in the R&A regulation which is a method for measuring a groove width for a golf club head used for official games. As shown in FIG. 3C, under the 30 degrees measurement rule, a distance between points at which imaginary lines L forming 30 degrees from the face 10 contact with the side surfaces 21 and 22 of the groove 20 respectively is measured as a width (Wr) of the groove 20. The width measured based on the 30 degrees measurement rule hereinafter is called "rule-based width". When the edges 24 of the groove 20 are rounded as in this embodiment, the width W of the groove 20 may be different from the rule-based width Wr. However, when the edges of the groove 20 are not rounded, the width W of the groove 20 conforms to the rule-based width Wr.

Further, the rule-based width Wr is stipulated to be not more than 0.9 (mm). The depth D of the groove is also stipulated in the rules to be not more than 0.5 (mm). Moreover, the pitch of grooves (a distance between the center lines CL of the grooves) is stipulated in the rules to be equal to or more than "the rule-based width" (Wr: mm)×4.

Now, referring again to FIG. 2A, an angle θ1 between the first surfaces 21*a* and 22*a* is larger than an angle θ2 between the second surfaces 21*b* and 22*b*. Because an increase in the angle θ1 makes angles of edges 24 of groove 20 (i.e. angles between the first surface 21*a*, 22*a*, and the face 10) wider, a ball can be prevented from getting damaged. Thus, the first surface portions 21*a* and 22*a* in portions of the groove 20 can contribute to preventing a ball from getting damaged.

Next, the fact that the angle θ2 is smaller than the angle θ1 can contribute to a further increase in a volume of the groove 20. In more detail, a configuration in which the side surfaces 21 and 22 of the groove 20 comprise the first surface 21*a*, 22*a* and the second surface 21*b*, 22*b* which are tilted by different angles from one another can provide a wider width at the bottom side, compared to a configuration in which the side surfaces 21 and 22 comprise only the first surface 21*a*, 22*a*. That is, this can increase the volume of the groove 20. Therefore, portions of the groove 20 may share the function, i.e. the second surfaces 21*b* and 22*b* can contribute to securing the volume of the groove.

Next, the larger the cross section area of the groove 20 is, the larger the volume of the groove 20 becomes. A cross section area ratio as an evaluation indicator of an amplitude of the cross section area of the groove 20, i.e. an amplitude of the volume of the groove 20 will be proposed as described below. As described previously, the depth D of the golf club head for official games is stipulated in the rules to be not more than 0.5 (mm). Therefore, when edges of the groove 20 are not rounded and the rule-based width Wr is applied to the groove 20, the largest cross section area of the groove 20 is Wr (mm)×0.5 (mm)=0.5·Wr ($mm^2$), as shown in the right side of FIG. 3B.

Now, the cross section area ratio of the cross section area S ($mm^2$) (see the left side of FIG. 3B) of the groove 20 to this largest cross section area can be an evaluation indicator which represents the amplitude of the volume of the groove 20. The cross section area ratio is expressed in the following expression (1):

$$\text{The cross section area ratio } (\%) = S/(Wr \times 0.5) \times 100 \qquad \text{expression (1)}$$

Next, an area ratio of a grooved area of the groove 20 in the face 10 affects the amount of spin of a ball. In this embodiment, an area ratio derived from the following expression (2), as an indicator of the area ratio of the grooved area, will be proposed.

$$\text{The grooved area ratio } (\%) = W/Ws \times 100 \qquad \text{expression (2)}$$

In the golf club head 1 of this embodiment, rounding of the edge 24 of the groove 20 prevents a ball from getting damaged. Further, balancing between the grooved area ratio of the groove 20 specified in the expression (2) given above and the cross section area ratio of the groove 20 specified in the expression (1) given above allows a large decrease in the amount of spin of a ball to be avoided in the rain or a shot in the rough. In this embodiment, the grooved area ratio of the groove 20 given above is set to equal to or more than 40%, and the cross section area ratio of the groove 20 given above is set to equal to or more than 70%.

In the golf club head 1 of this embodiment, such a configuration above can prevent the amount of spin of a ball in the rain or a shot in the rough from decreasing largely while avoiding damage to a ball.

EXAMPLES

FIG. 5 shows the experimental conditions (groove specifications) under which a degree of ball damage (a degree of scratches) and an amount of spin of a ball were measured with varying specifications of the grooves for examples 1 and 2 of the present invention and for comparative examples 1 to 8. FIGS. 6 and 7 show the experimental result. The experiments were performed by using a sand wedge with a loft angle of 56 degrees, providing grooves in the sand wedge to which grooves different specifications were applied and hitting unused balls by the wedge driven by a robot machine. The head speed of the sand wedge was set to 40 (m/s). Moreover, taking cases of shots in clear weather and cases of shots in the rain or in the rough into consideration, for the dry face (dry) and for the face covered with a thin wet paper (wet), ten balls were hit, respectively.

In FIG. 5, in the column of "Cross section shape" shows cross section shapes of the comparative examples and examples. "Single side surface (trapezoidal)" corresponding to comparative examples 1, 2 and 5 to 8 represents the cross section shape of a groove 120 shown in FIG. 4A, and the groove 120 is symmetric about the center line thereof. An angle θ1 is such that it is formed between a side surface 121 and a side surface 122, and the side surface 121, 122 includes a single surface having no angle change therein.

Figure 4A:
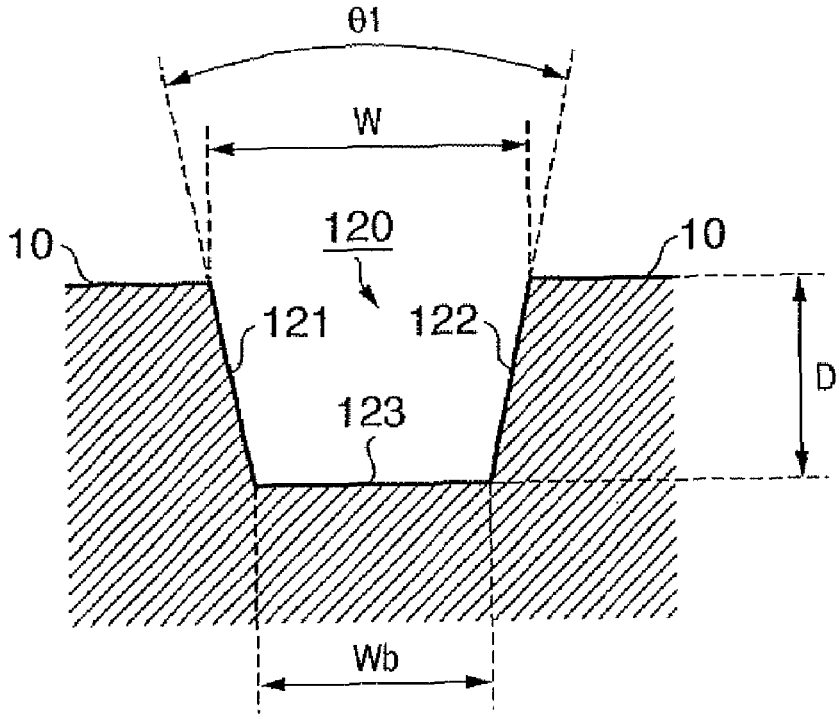
FIGS. 4A and 4B are cross sectional views showing the groove of a comparative example.
Figure 4B:
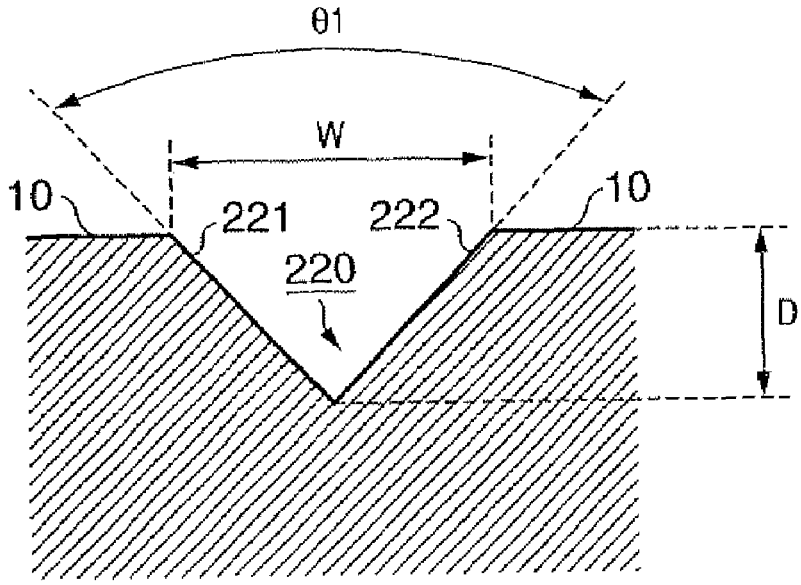

"Single side surface (V-shaped)" corresponding to the comparative examples 4 and 5 represents the cross section shape of a groove 220 shown in FIG. 4B, and the groove 220 is symmetric about the center line thereof. An angle θ1 is such that it is formed between a side surface 221 and a side surface 222, and the side surface 221, 222 includes a single surface having no angle change therein. "Side surface segmented into two surfaces" corresponding to the examples 1 and 2 represents the cross section shape shown in FIG. 2A.

"Angle θ1", "Angle θ2", and "Groove depth D", each of them represents a value of a dimension corresponding to a reference character shown in FIG. 2A, FIGS. 4A and 4B, respectively. "Radius for rounding" represents a radius for rounding the groove edges. In the comparative examples 1 to 7, the groove edges are not rounded. "Groove width W" is the groove width which was explained with reference to FIG. 3A and is to be measured including the roundness. "Rule-based width Wr" is the groove width measured based on the 30 degrees measurement rule. In each of the comparative examples 1 to 7, the groove edges are not rounded (a radius for rounding: r=0). Therefore, in each case, the width W conforms to the rule-based width Wr and is set to 0.9 (mm) as shown in FIG. 5.

"Width between the grooves Ws" is the width Ws explained with reference to FIG. 3A. "Pitch" is a distance between the center lines (the center line CL shown in FIG. 2A) of the adjacent grooves. "Grooved area ratio" is the grooved area ratio above calculated by using the expression (2) above. "Cross section area S" is the cross section area of the groove. "Cross section area ratio" is the cross section area ratio above calculated by using the expression (1) above.

"Rule conformity" shows whether the golf club heads used in the comparative examples 1 to 8 and the examples 1 and 2 conform to the rules applied to the golf club head for official games or not. Only the comparative example 7 does not conform to the rules as regarding the pitch.

Next, in the experimental result shown in FIG. 6, "Degree of scratches" was evaluated in 1-to-10 scale by the three persons who observed visually and tactilely a degree of damage incurred on the surfaces of balls after hitting for the dry face (dry). In this experiment, "10" was assigned to the largest degree of damage incurred on the surfaces of the balls and "1" was assigned to the smallest degree of damage. "Amount of spin" was derived from change in the position of an indicator marked in advance on the surface of a ball measured by video recording of the ball upon impact. The amount of spin is an average value of ten shots, for the dry face (dry) and for the wet face (wet), respectively.

Figure 7A:
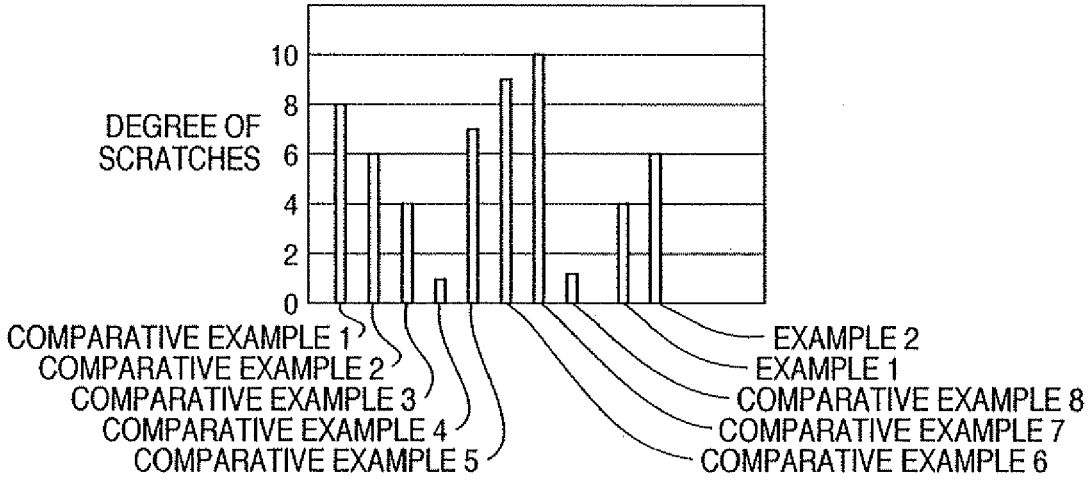
FIGS. 7A to 7C show the experimental result of the examples of the present invention and the comparative examples.
Figure 7B:
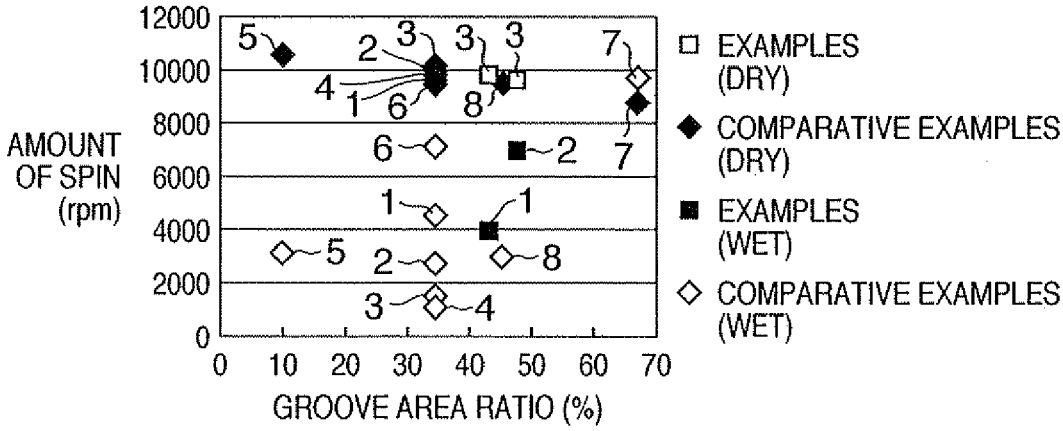
Figure 7C:
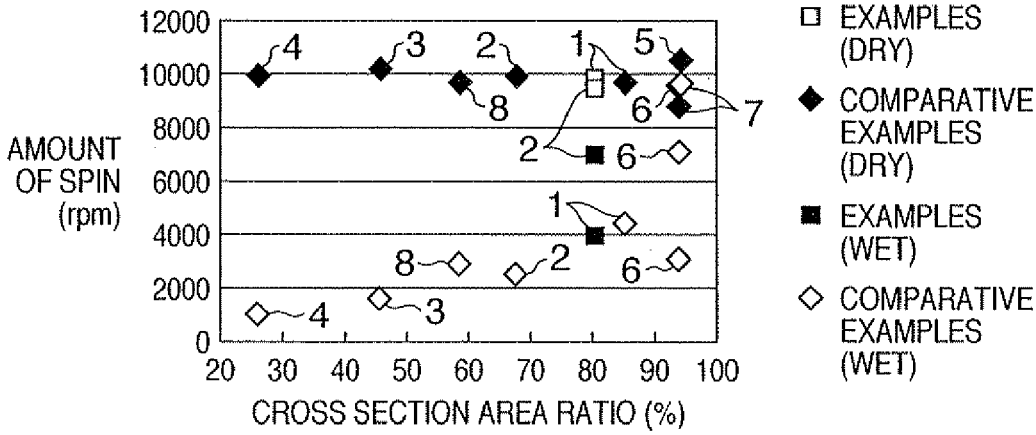

FIG. 7A is a bar graph plotted for illustrating the degree of scratches in the experimental result shown in FIG. 6. FIG. 7B is a graph plotted for illustrating relation between "Grooved area ratio" and "Amount of spin" of the experimental result shown in FIG. 6 in a separate form for the dry face and for the wet face. FIG. 7C is a graph plotted for illustrating relation between "Cross section area ratio" and "Amount of spin" of the experimental result shown in FIG. 6 in a separate form for the dry face and for the wet face.

Then, focusing attention on the degree of scratches, a large degree of scratches is found in the comparative examples 1, and 5 to 7 in which the angle θ1 is small and the groove edges are not rounded. Therefore, an increase in the angle θ1 and rounding of the groove edges have an effect to prevent a ball from getting damaged.

Next, studying the relations between "Amount of spin", and "Grooved area ratio" and "Cross section area ratio", first, the comparative examples 1 to 4, and 6 have the same "Grooved area ratio", but deferent "Cross section area ratio", and "Amount of spin" in the wet case becomes larger proportionally to "Cross section area ratio". Therefore, a larger "Cross section area ratio" can allow the amount of spin to increase in the wet case. On the contrary, the comparative examples 5 to 7 have the same "Cross section area ratio", but deferent "Grooved area ratio", and "Amount of spin" becomes larger proportionally to "Grooved area ratio" in the wet case. Therefore, a larger "Grooved area ratio" can allow the amount of spin to increase in the wet case. It can be seen from these relations that balancing between "Grooved area ratio" and "Cross section area ratio" can provide improvement in the amount of spin in the wet case.

Next, comparing the examples with the comparative examples in whole, in point of "Amount of spin" in the wet case, the comparative examples 6 and 7 exceed the examples 1 and 2, and the comparative example 1 exceeds the example 1. However, in point of "Degree of scratches", the comparative examples 1, 6 and 7 are inferior to the examples 1 and 2. Further, the comparative example 7 does not conform to the rules applied to the golf club head for official games. The comparative examples 2 and 3 are almost similar to the examples 1 and 2 from the viewpoint of "Degree of scratches", but inferior to them from the viewpoint of "Amount of spin" in the wet case, and significantly inferior especially to the example 2. The comparative examples 4 and 8 are superior to the examples 1 and 2 in point of "Degree of scratches", but inferior to them in point of "Amount of spin" in the wet case, and significantly inferior especially to the example 2. Based on the foregoing, it can be considered on the whole that the golf club heads of the examples 1 and 2 are more well-balanced golf club heads between "Degree of scratches" and "Amount of spin", compared to that of the comparative examples 1 to 8.

Next, although the example 1 and the comparative example 2 have the angle θ1 of about the same angle (66, 60 degrees), the example 1 has a smaller decrease in the amount of spin of the wet case relative to the dry case. Here, the example 1 has "Grooved area ratio" of 42% and "Cross section area ratio" of 80%, and the comparative example 2 has "Grooved area ratio" of 33% and "Cross section area ratio" of 68%. Accordingly, it is conceivable that setting of "Grooved area ratio" to equal to or more than 40% and "Cross section area ratio" to equal to or more than 70% allows a golf club head having a small decrease in the amount of spin in the wet case to be achieved.

Moreover, although the example 2 and the comparative example 1 have the angle θ1 of the same angle (30 degrees), the example 2 has a smaller decrease in the amount of spin of the wet case relative to the dry case. Here, the example 2 has "Grooved area ratio" of 47% and "Cross section area ratio" of 80%, and the comparative example 1 has "Grooved area ratio" of 33% and "Cross section area ratio" of 85%. Although the comparative example 1 has "Grooved area ratio" of a higher value, the example 2 has a smaller decrease in the amount of spin of the wet case relative to the dry case. Therefore, it can be considered that setting of "Grooved area ratio" to equal to or mare than 40% also allows a golf club head having a small decrease in the amount of spin in the wet case to be achieved.

Comparing the example 1 with the example 2, there are "the angle θ1" (66, 30 degrees) and "Grooved area ratio" (42, 47%) including differences in values of parameters which are considered to affect the amount of spin. The example 2 has a smaller decrease in the amount of spin of the wet case relative to the dry case than that of the example 1. Therefore, it is conceivable that setting of "the angle θ1" to not more than about 50 degrees by taking an approximately intermediate value between the values of both sides allows a golf club head having a further smaller decrease in the amount of spin in the wet case to be achieved.

When the golf club head of the present invention is used in regular games, it is required that the rule-based width Wr of the groove is not more than 0.9 (mm). However, the narrower the rule-based width Wr is, the smaller the cross section area of the groove becomes. Therefore, the rule-based width Wr of the groove of the golf club head according to the present invention is preferably equal to or more than 0.6 (mm) and not more than 0.9 (mm).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A golf club head comprising:

a plurality of grooves formed on a face of the golf club head; and each groove of said plurality of grooves including a pair of side surfaces of, each side surface having a first surface contiguous with the face and a second surface contiguous with said first surface in a depth direction of said groove, wherein a first angle between said first surfaces of each of said pair of the side surfaces is larger than a second angle between said second surfaces of each of said pair of the side surfaces, edges of said groove are rounded, wherein a width W (mm) of said groove measured including said rounded edges and a width Ws (mm) representing a distance between said adjacent grooves satisfy a formula $$W/Ws \times 100 \geqq 40(\%), \text{ and}$$

wherein a width Wr (mm) of said groove measured based on a 30 degrees measurement rule and a cross section area S ($mm^2$) of said groove satisfy a formula $$S/(Wr \times 0.5) \times 100 \geqq 70(\%).$$

2. The golf club head according to claim 1, wherein said first angle is not more than 50 degrees; and a radius for said rounded edge of said groove is not more than 0.2 mm.

3. The golf club head according to claim 1, wherein said width Wr (mm) of said groove measured based on the 30 degrees measurement rule is equal to or more than 0.6 (mm) and not more than 0.9 (mm).

4. The golf club head according to claim 1, wherein the width Wr (mm) and the cross section area S ($mm^2$) satisfy a formula $$S/(Wr \times 0.5) \times 100 \geqq 80(\%).$$

5. The golf club head according to claim 1, wherein the width W (mm) and the width Ws (mm) satisfy a formula $$42(\%) \leqq W/Ws \times 100 \leqq 47(\%).$$

6. The golf club head according to claim 1, wherein said groove includes a bottom that is contiguous with each second surface of the pair of side surfaces.

* * * * *